US005542901A

United States Patent [19]

Atwell et al.

[11] Patent Number: 5,542,901

[45] Date of Patent: Aug. 6, 1996

[54] VACUUM ARRANGEMENT ON COMBINER

[75] Inventors: Charles G. Atwell, Mechanicsville; Joseph F. Budjinski, II, Quinton; Jack R. Shook, Doswell, all of Va.

[73] Assignee: Philip Morris Incorporated, New York, N.Y.

[21] Appl. No.: 216,114

[22] Filed: Mar. 22, 1994

Related U.S. Application Data

[63] Continuation-in-part of Ser. No. 34,085, Mar. 22, 1993, Pat. No. 5,322,495, which is a continuation of Ser. No. 874,542, Apr. 27, 1992, Pat. No. 5,221,247.

[51] Int. Cl.[6] ..... A24D 3/02; A24C 5/47

[52] U.S. Cl. ..... 493/47; 131/84.1; 131/61.1

[58] Field of Search ..... 493/42, 41, 43, 493/44, 45, 46, 47; 198/803.5; 131/84.1, 84.3, 61.1

[56] References Cited

U.S. PATENT DOCUMENTS

| | | | |
|---|---|---|---|
| 3,312,151 | 10/1964 | Molins | 93/1 |
| 3,312,152 | 4/1967 | Williamson | 93/1 |
| 3,623,404 | 6/1969 | Jackson | 493/48 |
| 3,837,264 | 9/1974 | Sexstone | 493/42 |
| 3,844,200 | 10/1974 | Sexstone | 93/1 |
| 3,884,741 | 5/1975 | Sexstone | 156/259 |
| 4,197,864 | 4/1980 | Molins | 493/42 |
| 4,412,829 | 11/1983 | Lebet et al. | 493/48 |
| 4,425,107 | 1/1984 | Hall | 493/48 |
| 4,729,386 | 3/1988 | Heitmann | 131/84.1 |
| 4,732,164 | 3/1988 | Heitmann | 131/84.3 |
| 4,861,324 | 8/1989 | Hirose et al. | 493/48 |
| 5,163,452 | 11/1992 | Marritt | 131/84.1 |
| 5,176,606 | 1/1993 | Budjinski, III et al. | 493/47 |
| 5,199,447 | 4/1993 | Budjinski, II et al. | 131/94 |
| 5,360,021 | 11/1994 | Belvederi | 131/84.1 |

*Primary Examiner*—Jack W. Lavinder
*Assistant Examiner*—Christopher W. Day
*Attorney, Agent, or Firm*—Charles E. B. Glenn; James E. Schardt; Kevin B. Osborne

[57] ABSTRACT

This invention relates to a method for delivering free-flowing material into discrete receiving spaces separating filter plugs in partially constructed cigarette filter assemblies. The method includes rapidly feeding a free-flowing material such as charcoal into partially constructed cigarette filter assemblies. The free-flowing material is dispensed to a first conveyance and is subsequently transferred to a second conveyance that is positioned parallel and above the first conveyance. Vacuum is used to hold the free-flowing particulate material onto the first conveyance and is used to transfer the free-flowing material to the second conveyance and to hold it there. The free-flowing material is next transferred onto receiving spaces formed between articles such as cigarette filter plugs that are disposed on a third conveyance. The transfer of the free-flowing material to the receiving spaces and retention is also facilitated by application of vacuum.

12 Claims, 19 Drawing Sheets

VACUUM ARRANGEMENT ON COMBINER

CROSS REFERENCE TO RELATED APPLICATIONS

This application is a continuation-in-part of commonly-assigned U.S. patent application Ser. No. 08/034,085,, filed Mar. 22, 1993, now U.S. Pat. No. 5,322,495, which is a continuation of commonly-assigned U.S. patent application Ser. No. 07/874,542, filed Apr. 27, 1992, which has issued as U.S. Pat. No. 5,221,247, which prior related applications are hereby incorporated by reference in their entirety.

BACKGROUND OF THE INVENTION

This invention relates to a method and device for use in the manufacture of cigarette filters. More particularly, this invention relates to a method and device for very high speed delivery of controlled amounts of a free-flowing material into discrete receiving spaces between individual filter plugs in partially-constructed cigarette filters. The device of this invention has a plurality of conveyance devices, each utilizing vacuum to rapidly and efficiently transfer and accurately place the free-flowing material into the discrete receiving spaces.

Some of the present devices used to transfer a free-flowing material into discrete spaces between filter plugs in cigarette filters are limited in operating speed due to the time required for the free-flowing material to free fall under the influence of gravity. For example, in Williams, U.S. Pat. No. 3,312,152, powder is transferred from a hopper to a pocket vacuum, but later, the powder free falls from that pocket into another pocket solely under the influence of gravity. Still later the powder again free falls from the later pocket into receiving spaces between filter plugs. Once delivered, the delivered powder, together with the filter plugs are transported to the next processing station. During that travel, the powder is subject to jostling, drum vibration and other causes, which may allow some particles to escape from the receiving spaces. The escape of particles from the pocket can be problematic, especially at elevated operational speeds, whereat vibration and jostling becomes more pronounced.

In the production of charcoal filter plugs with a device such as in Williamson, U.S. Pat. No. 3,312,152, the escape of charcoal particles from the receiving spaces can be ruinous to the acceptability of filter plugs produced by the apparatus. Many of the particles which escape become smeared along the periphery of the filter plugs as the plugs are directed through the garniture downstream of the particle transfer apparatus. The smeared particles render an unsightly smear about the edges of the final filter product.

Other devices utilize vacuum but also are limited in the speeds they can operate due to the limited period of contact between a transferring receptacle and a receiving receptacle. For example, in Molins, U.S. Pat. No. 3,312,151, powdered filter material is transferred from a hopper to pockets under vacuum, and then from the pockets to receiving spaces between the filter plugs under vacuum. However, each pocket only registers with the receiving space at one location. The wheel must rotate slowly enough to allow a suitable period of alignment between the transferring pocket and the receiving space. The device in Molins '151 suffers the same disadvantages as the device taught in Williamson '152, being prone to allow particles to escape from the receiving spaces during movement beyond the delivery location.

It would be desirable to replace the present devices with devices utilizing vacuum at all stages of the transfer of the free-flowing material. Vacuum facilitates transfer of free-flowing material at a much more rapid rate than gravity alone. It would likewise be desirable to replace the prior devices with devices utilizing periods of parallel travel between the transferring receptacles and the receiving receptacles. Such parallel travel extends the period of contact between the receptacles, thus expanding the time available for transfer of the free-flowing material while still facilitating a very rapid process. Such use of vacuum and parallel travel would enable a device to deliver a free-flowing material at a much more rapid rate than present devices. Additionally, it would be desirable to have an arrangement where vacuum is applied to receiving spaces such that particles are more completely delivered and positively retained until completion of wrapping operations.

SUMMARY OF THE INVENTION

It is an object of this invention to provide a method and device for the delivery of controlled amounts of a free-flowing material into discrete receiving spaces in partially-constructed cigarette filters at a very high speed and without smears from escaped material.

It is a further object to provide a method and device utilizing vacuum for the transfer of free-flowing material into receiving spaces between cigarette filter plugs.

It is a further object to provide a method and device utilizing periods of parallel travel of the transferring receptacles with respect to the receiving receptacles for the free-flowing material.

It is a further object to protect the outer surfaces of filter plugs in the partially constructed cigarette filters from exposure or contact with the free-flowing material before, during and after delivery of the material.

These and other objects of this invention are accomplished by providing a method and device which includes parallel traveling vacuum-assisted conveyors and containers for transporting and placing controlled amounts of a free-flowing material into discrete receiving spaces between filter plugs with great speed and precision. The method and device of this invention may also include a screening tape to protect the filter plugs in the partially-constructed cigarette filters from exposure to the free-flowing material.

The device of this invention includes a metering device for dispensing a measured amount of a free-flowing material. The metering device may include a hopper to contain the free-flowing material and a cylindrical metering drum with recesses. Such a metering drum rotates beneath the hopper and the recesses trap measured amounts of the free-flowing material. The rotating metering drum then carries the free-flowing material to a point where it is released above a funnel. The funnel channels the free-flowing material to fall onto a rapidly moving transport tape located below the funnel.

The high speed transport tape or belt which receives the free-flowing material from the funnel is permeable to air. Vacuum applied beneath the transport tape draws the free-flowing material onto the surface of the tape, and holds it on the tape surface under vacuum. The transport tape then conveys the free-flowing material on a course parallel with and underneath a series of moving containers or pockets, each designed for receiving and holding a measured amount of free-flowing material.

Each pocket structure may contain an aperture which is divided by a screen into upper and lower portions. The pockets may be separate containers, each of which is attached to a continuous or endless belt which travels around a plurality of wheels oriented in the horizontal plane. Alternatively, the pockets may be containers directly piercing through and held within a continuous or endless belt which travels around a plurality of wheels oriented in the vertical plane. In either case, the continuous belt travels on a course that is, in part, parallel with and adjacent to the transport tape. During this period of parallel travel, the belt serves to position the pockets directly above the free-flowing material carried on the high speed transport tape.

At a point where the transport tape is traveling beneath the pockets, the vacuum applied to the tape ceases. Simultaneously, a vacuum hood directing vacuum through the apertures in the pockets engages. This vacuum serves to draw the free-flowing material off the transport tape and up into the lower portion of said pockets where measured amounts of the material are held in place. A screen in each pocket retains the free-flowing material in place and thus allows the applied vacuum to hold the free-flowing material in the pocket. Adjustment of the relative speed differences between the transport tape and the continuous belt carrying the pockets serves to significantly enhance the uptake of the free-flowing material by the pockets and results in essentially none of the free-flowing material remaining on the transport tape.

The continuous belt then carries the pockets, each containing a measured amount of free-flowing material held under vacuum, to a point where the belt begins a course parallel with and adjacent to a traveling garniture tape, such that the pockets are positioned over the garniture tape. The garniture tape travels through a trough called a garniture, and the garniture tape assumes the trough shape of the garniture. The garniture tape conveys a ribbon of filter plug wrap which also assumes the trough shape of the garniture. A series of filter plugs separated by discrete receiving spaces are axially aligned within this trough-shaped plug wrap. The garniture tape and the plug wrap it transports are both permeable to air.

At approximately the point where each pocket begins its travel above the garniture tape, each pocket also travels out from under a vacuum hood. As atmospheric pressure or slightly positive pressure applies to each pocket, the free-flowing material is released from the pocket. Depending on the distance between the garniture tape and the receiving space, a vacuum may be applied at this point to facilitate the release of free-flowing material, or gravity itself may be used. A continuous screening tape may be used which travels in the space between the filter plugs and the pockets. This screening tape may be used to mask the filter plugs from contact with the free-flowing material while openings in the screening tape allow passage of the free-flowing material into the discrete receiving spaces.

A further aspect of the present invention provides an apparatus and method wherein vacuum is communicated through the air permeable garniture tape and the plug wrap throughout a path extending from where the free-flowing material is delivered to a location where the plug wrap is folded about the filter plugs to form the plug rod. The arrangement and method includes communicating the vacuum through a porous tube belt whose weave construction is adapted along its center portion to facilitate communication of the vacuum to the plug wrap. The arrangement and method provides positive retention of the material so as to enhance quality of the final product.

BRIEF DESCRIPTION OF THE DRAWINGS

The above and other objectives and advantages of the invention will be apparent upon consideration of the following Detailed Description, taken in conjunction with the accompanying drawings, in which like reference numerals refer to like parts throughout and in which.

DETAILED DESCRIPTION OF THE PREFERRED EMBODIMENTS

Figure 1:
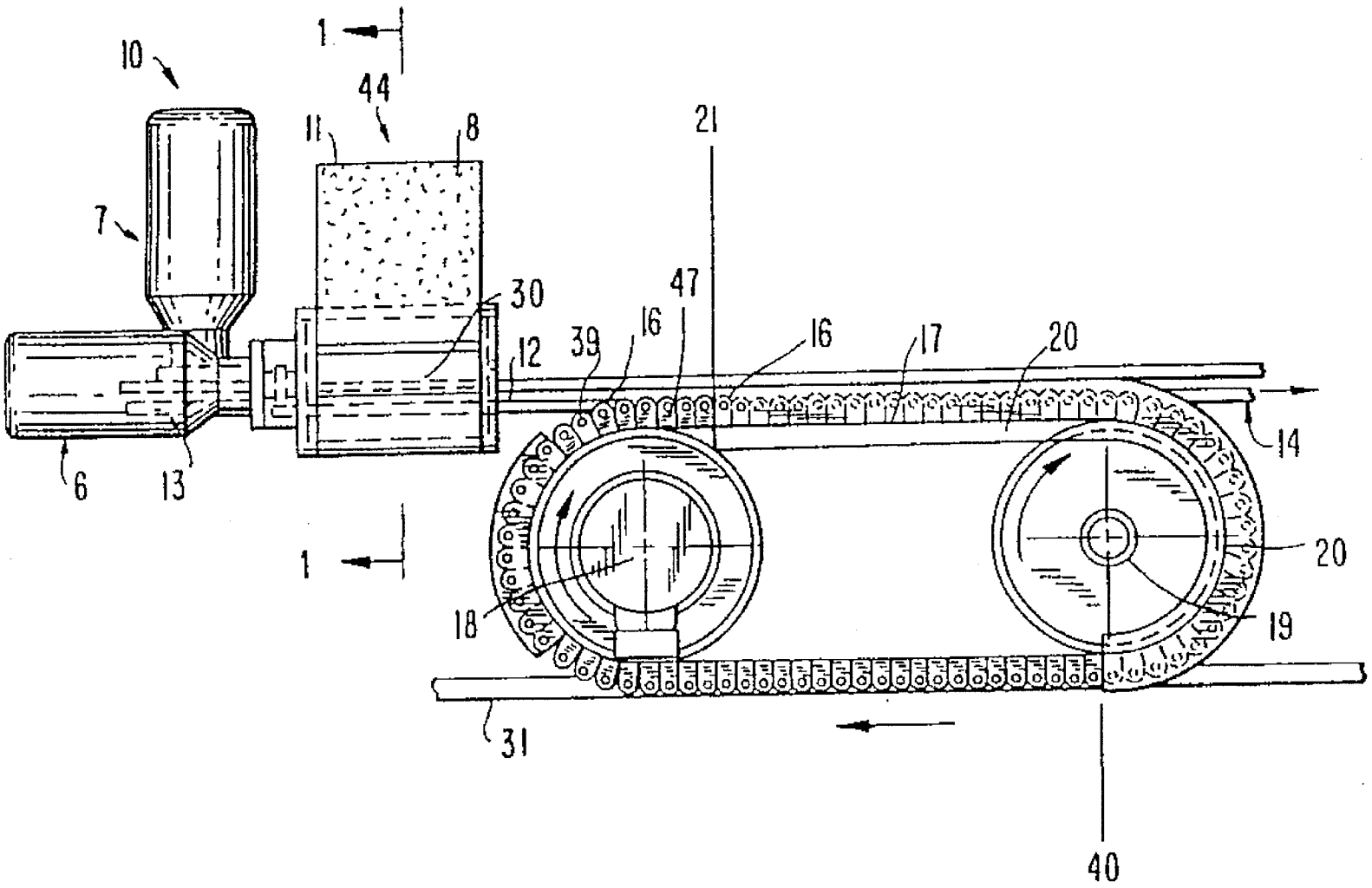
FIG. 1 is a top plan view of a preferred embodiment of the apparatus illustrating diagrammatically the basic relationship of several parts of the apparatus.
Figure 2:
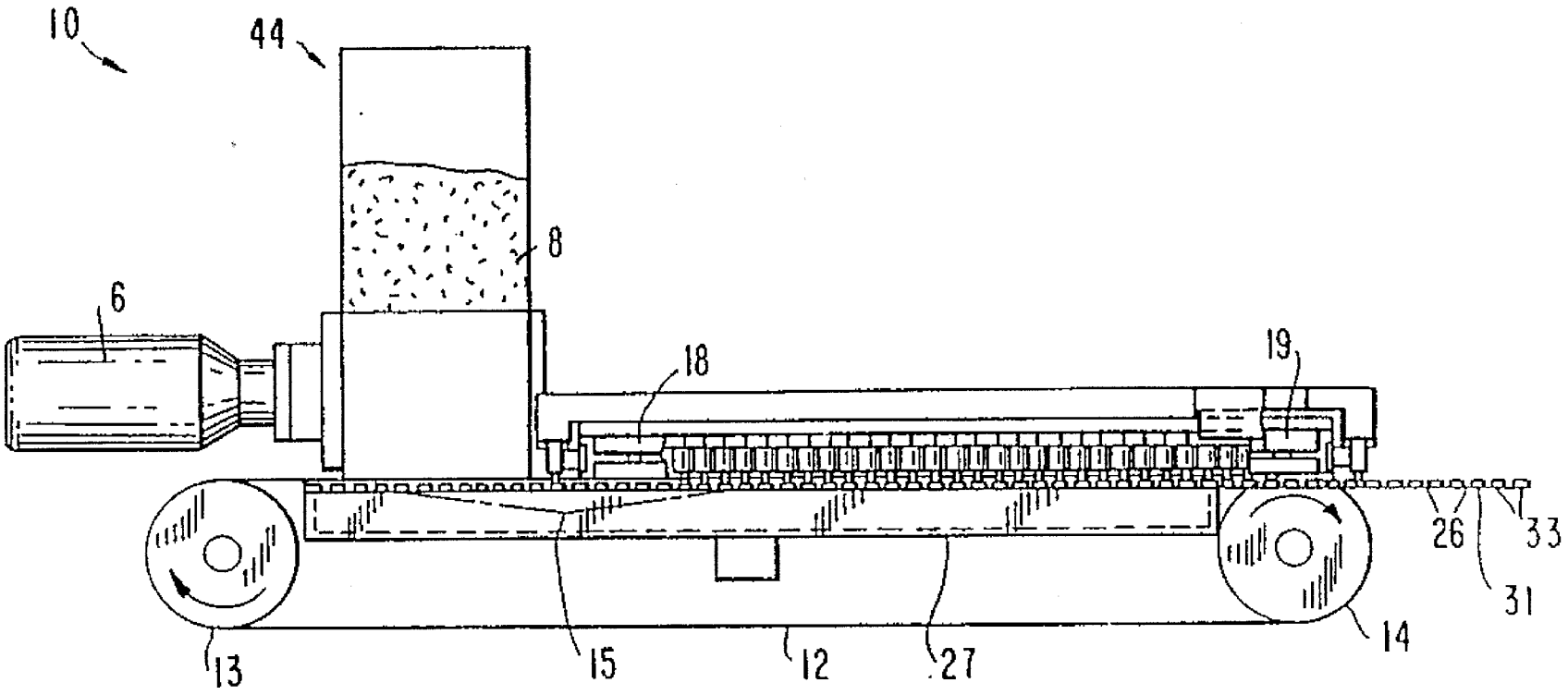
FIG. 2 is a full frontal view of the apparatus of FIG. 1.

Referring to the drawings, FIGS. 1 and 2 illustrate a device designated generally by reference numeral 10. FIG.

3 is a cross-sectional view of the metering drum dispensing device 44 represented in FIGS. 1 and 2. Dispensing device 44 includes a free-flowing material hopper 11 which contains a free-flowing material 8, such as charcoal, a powder, a granulated material or some other free-flowing material. Dispensing device 44 also includes a cylindrical metering drum 30 that may be driven by an electric motor 6. Cylindrical metering drum 30 is provided with a series of recesses 34 running parallel to the axis of metering drum 30 and covering the outer circumferential surface of metering drum 30. As metering drum 30 turns, recesses 34 catch free-flowing material from the hopper 11 and transport it around the inner wall 35 of drum cover 41 so that the free-flowing material subsequently falls into funnel 36. Funnel 36 channels the free-flowing material onto transport tape 12. Varying the speed of rotation of metering drum 30 controls the amount of free-flowing material delivered to funnel 36. Metering drum 30 turns at sufficient speed to provide sufficient free-flowing material to funnel 36 so that this stage of operation of the device does not limit the overall speed of operation of device 10.

Figure 3:
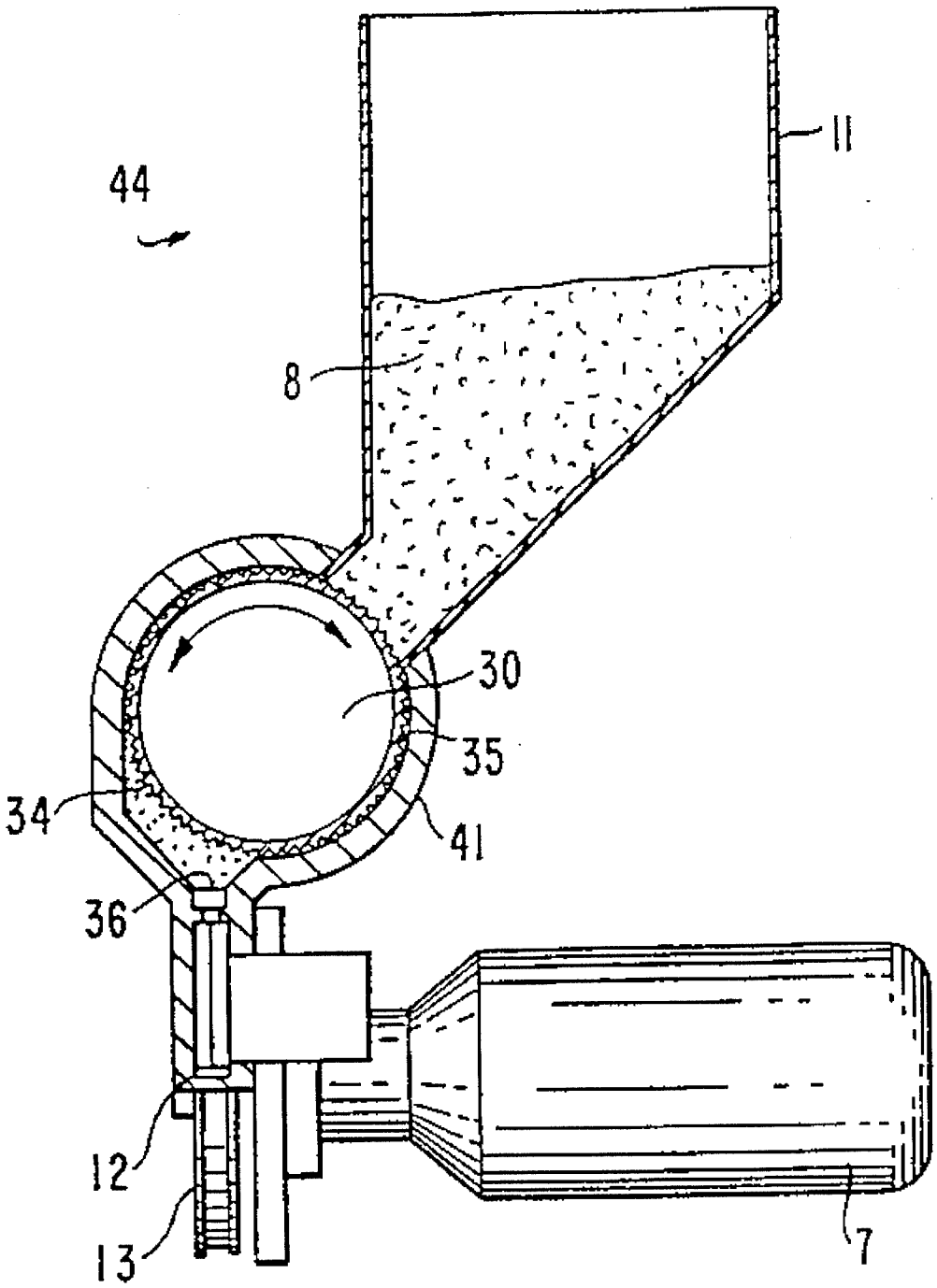
FIG. 3 is a sectional view of the apparatus of FIGS. 1–2, taken from line 1—1 of FIG. 1.

Transport tape 12 is an endless tape traveling around a plurality of wheels 13 and 14, aligned and positioned in the vertical plane. Wheels 13 and 14 function as spaced apart end sprockets providing drive, tension and position for tape 12. In the embodiment shown in FIGS. 1–3, wheel 13 is driven by an electric motor 7. Transport tape 12 is permeable to air but is impermeable to the free-flowing material. Vacuum from a vacuum chamber of plenum 15 located beneath transport tape 12 draws through the tape. This vacuum draws free-flowing material onto the surface of transport tape 12 and retains it in place, even as the tape moves at high speeds.

Figure 4:
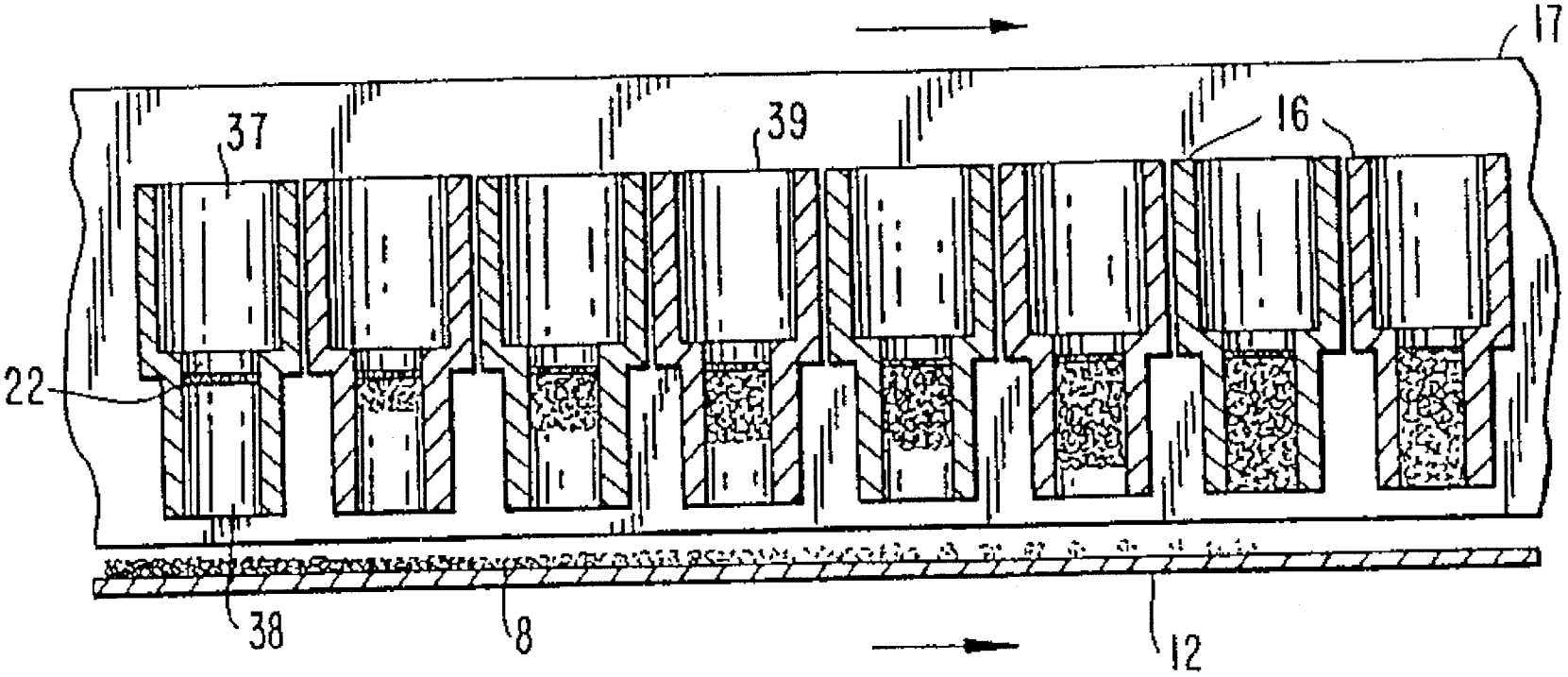
FIG. 4 is a cross-sectional view in fragmentary form of the apparatus of FIGS. 1–3, illustrating the basic relationship between the transport tape, the endless belt and the pockets.
Figure 5:
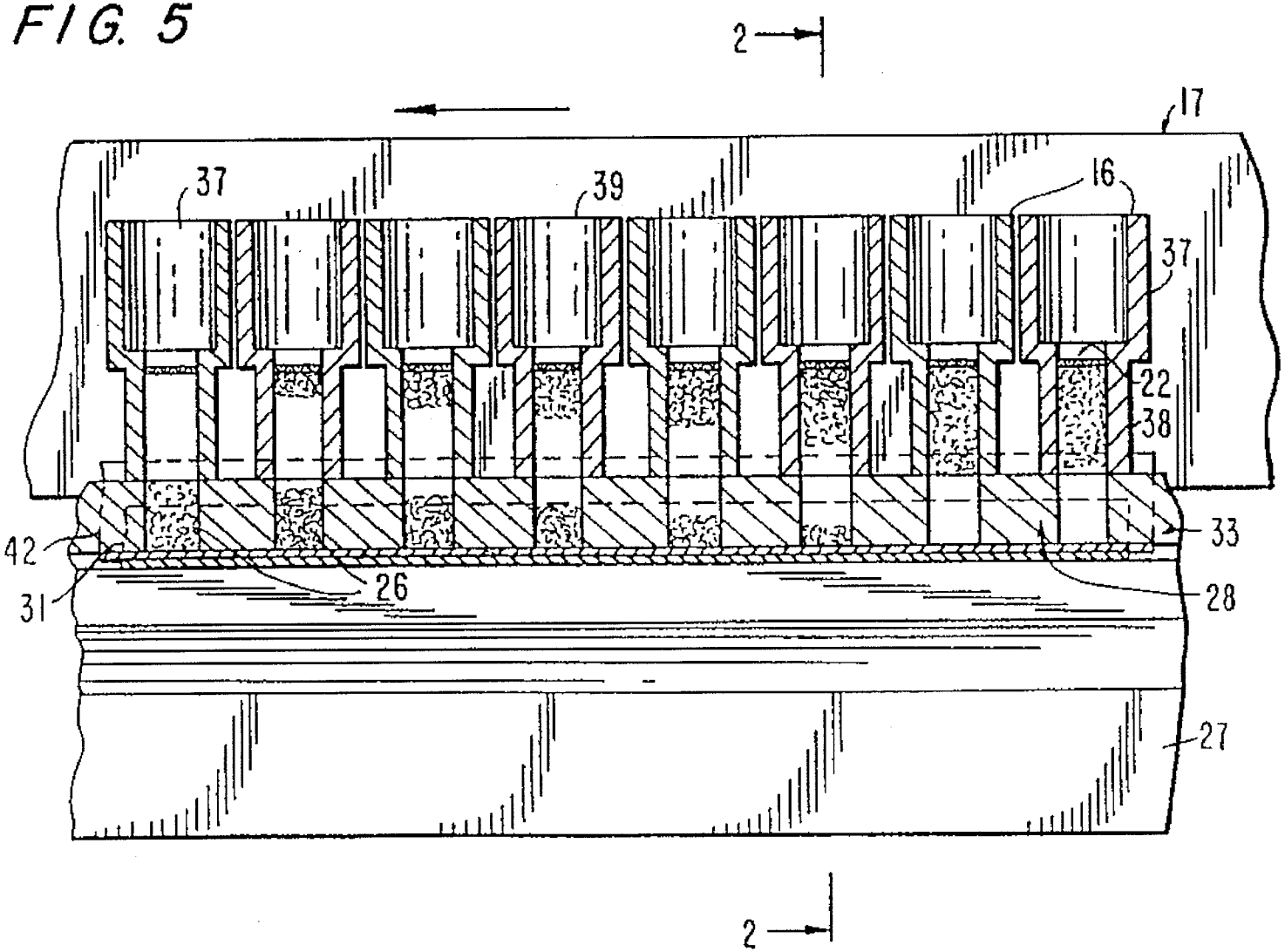
FIG. 5 is a cross-sectional view in fragmentary form of the apparatus of FIGS. 1–4, illustrating the basic relationship between the endless belt, the pockets, the garniture tape, the filter plug wrap and the garniture.
Figure 6:
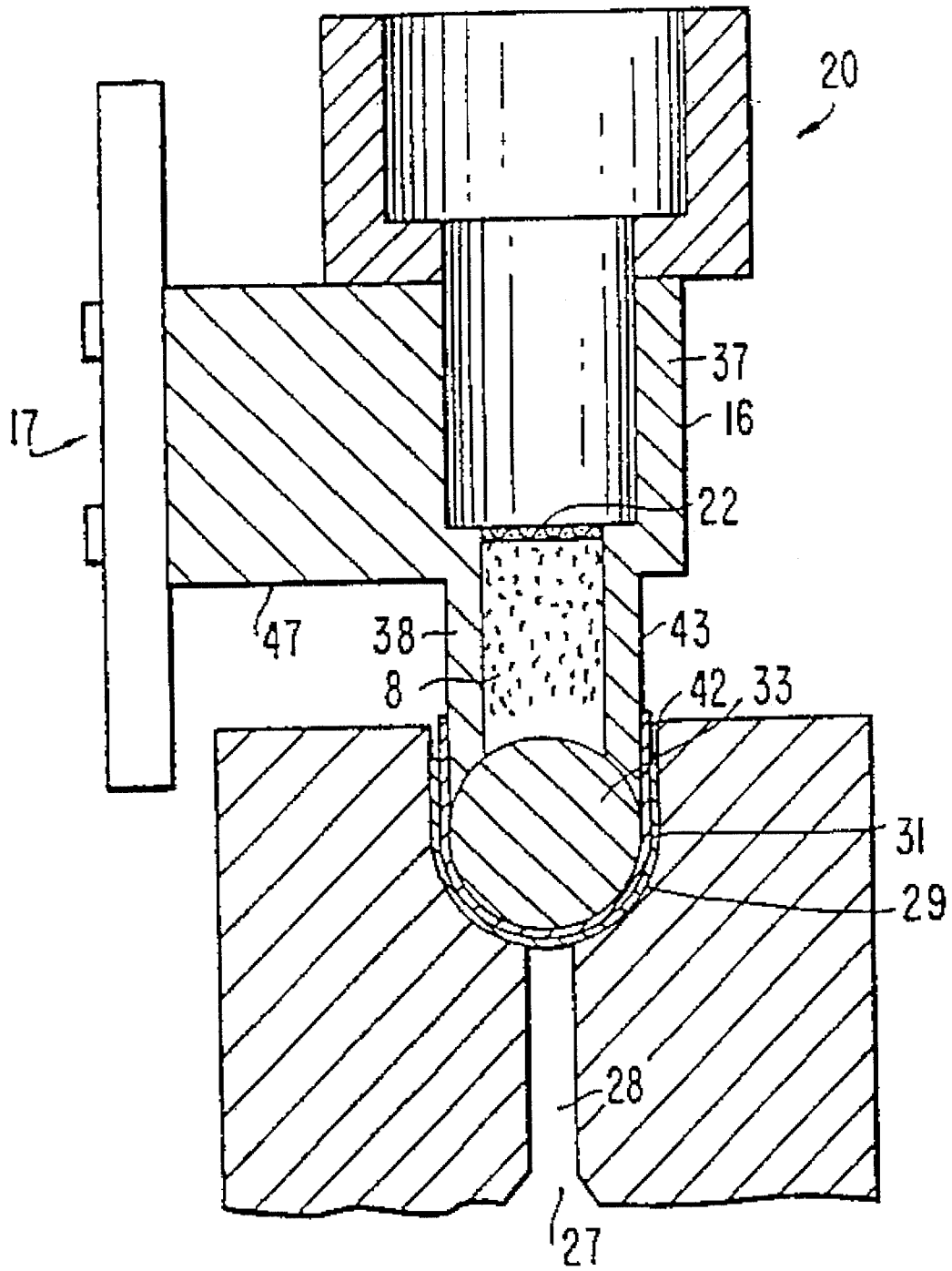
FIG. 6 is a sectional view of the apparatus of FIGS. 1–5, taken from line 2—2 of FIG. 5.
Figure 7:
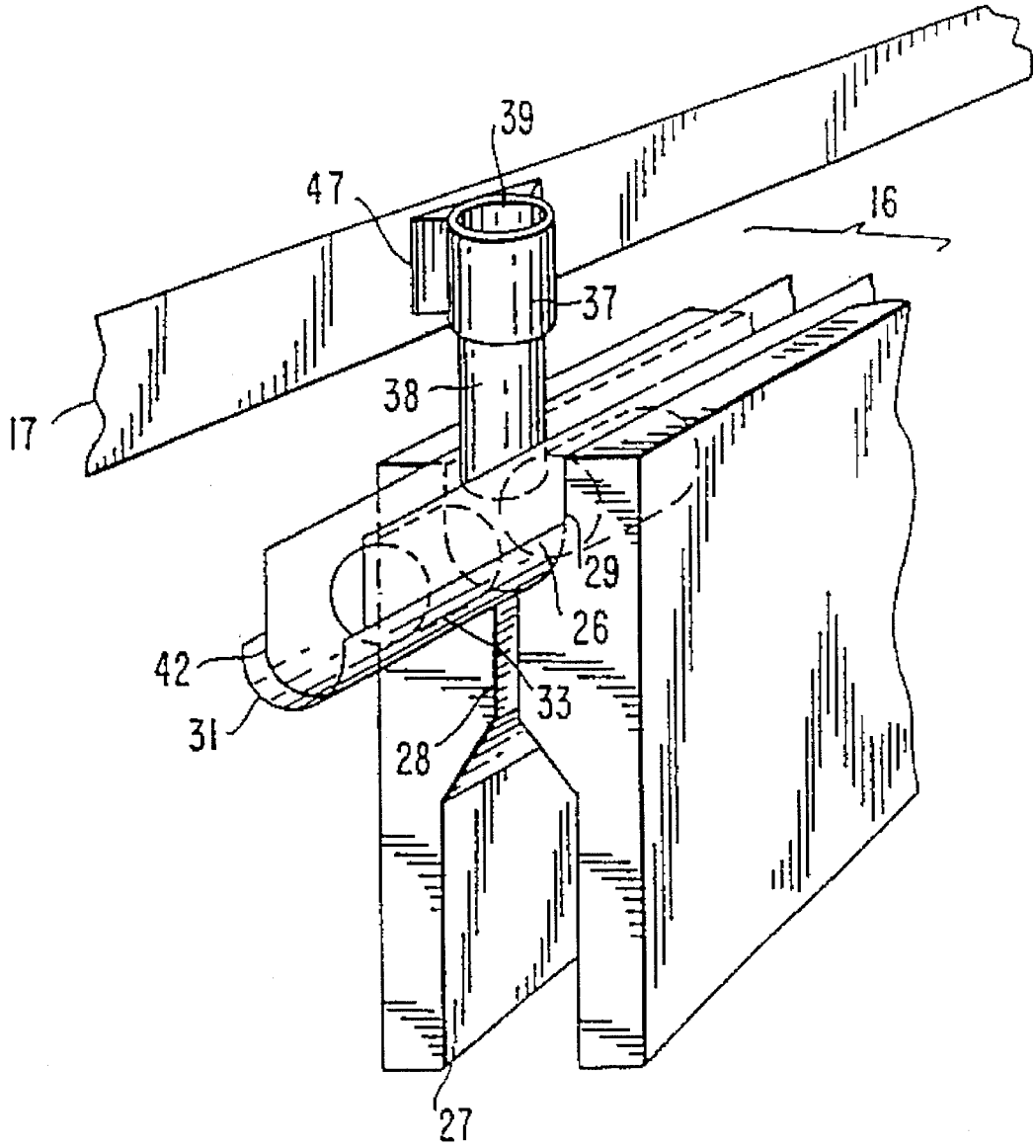
FIG. 7 is a perspective view in fragmentary form of the apparatus of FIGS. 1–6, illustrating the basic relationship between the endless belt, a pocket, the garniture tape, the filter wrap and the garniture.
Figure 8:
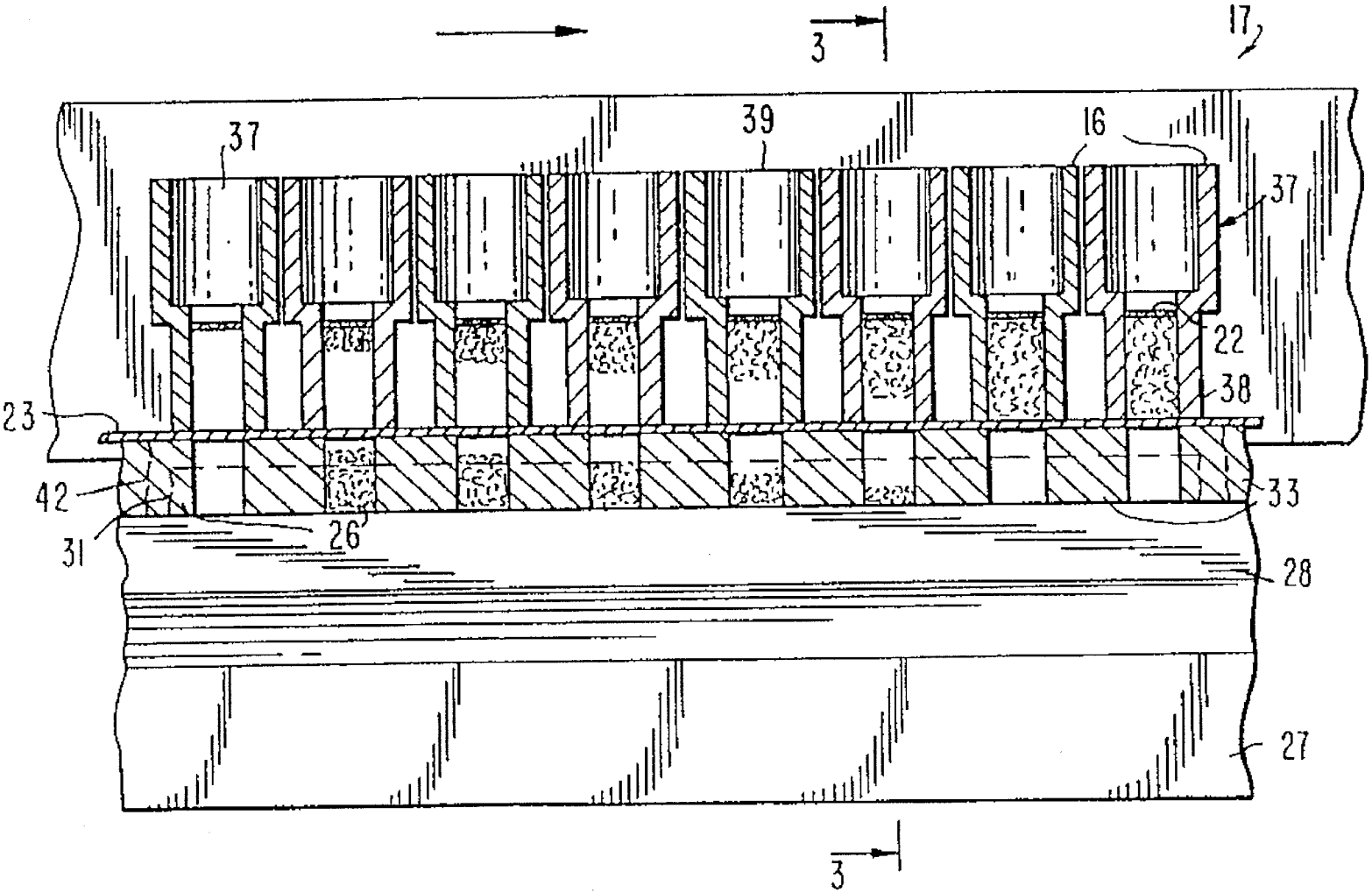
FIG. 8 is a cross-sectional view in fragmentary form, similar to FIG. 5, but of an embodiment with a screening belt.
Figure 9:
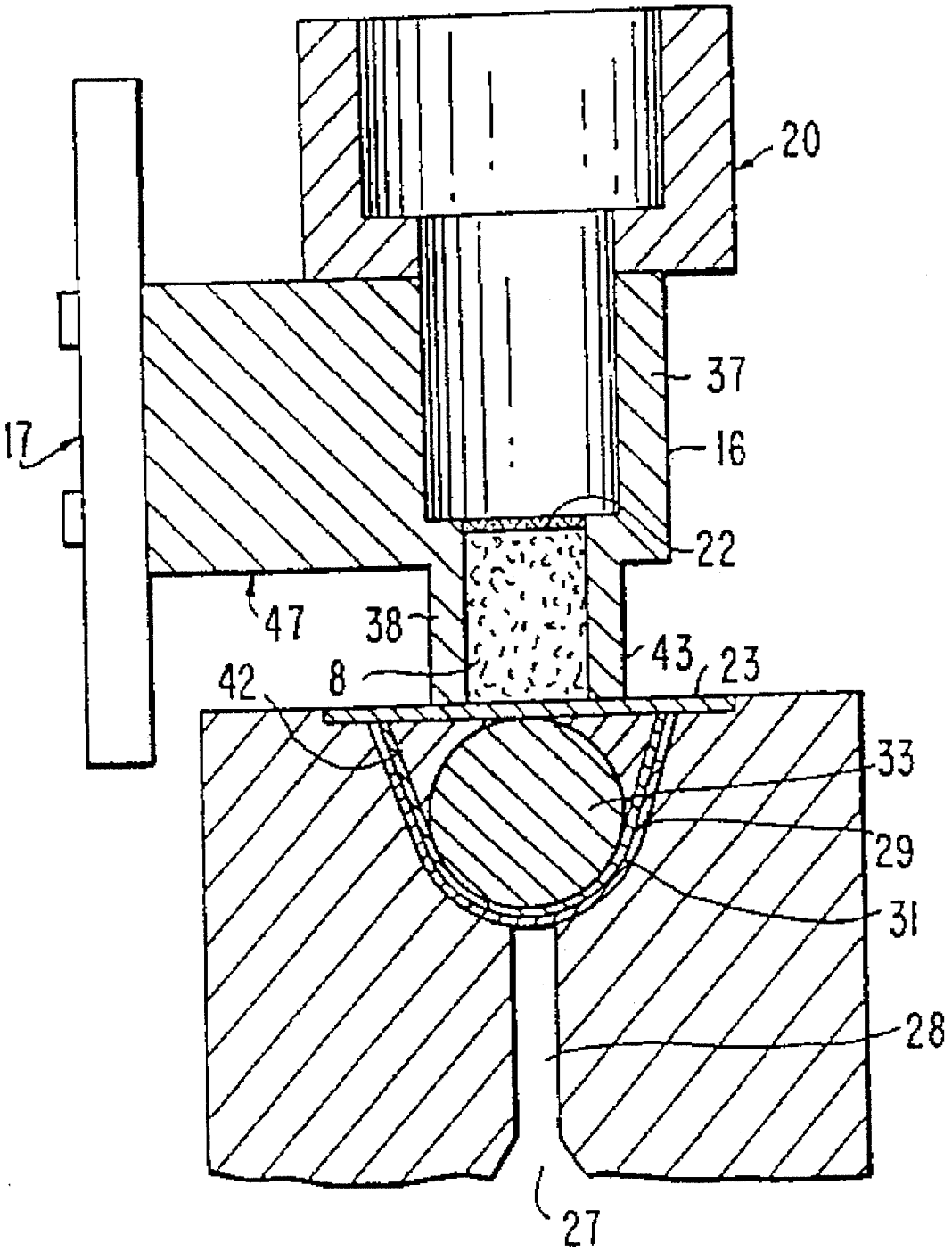
FIG. 9 is a sectional view of the apparatus of FIG. 8, taken from line 3—3 of FIG. 8.
Figure 10:
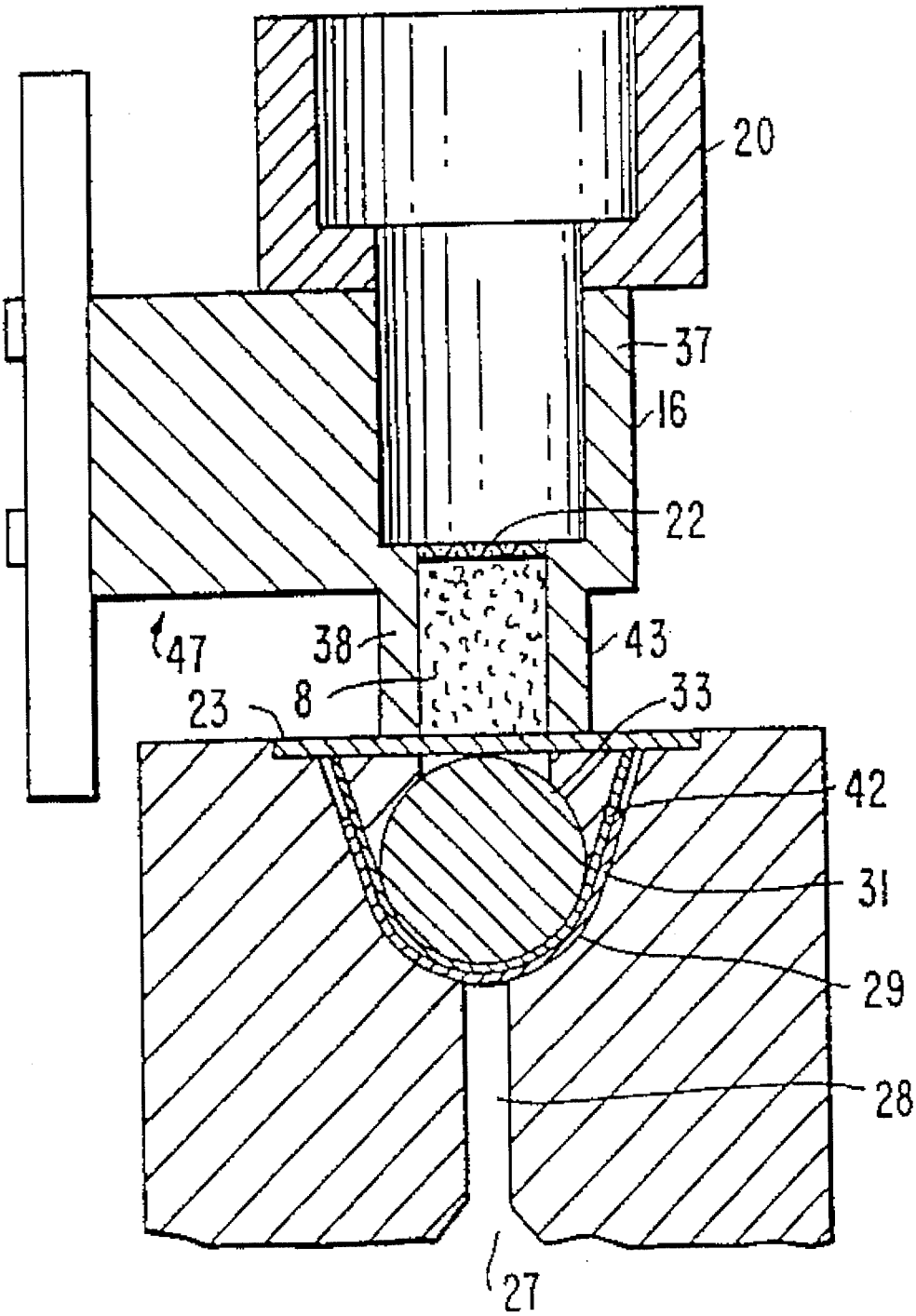
FIG. 10 is an enlarged version of a portion of FIG. 9, also showing a sectional view taken from line 3—3 of FIG. 8.
Figure 11:
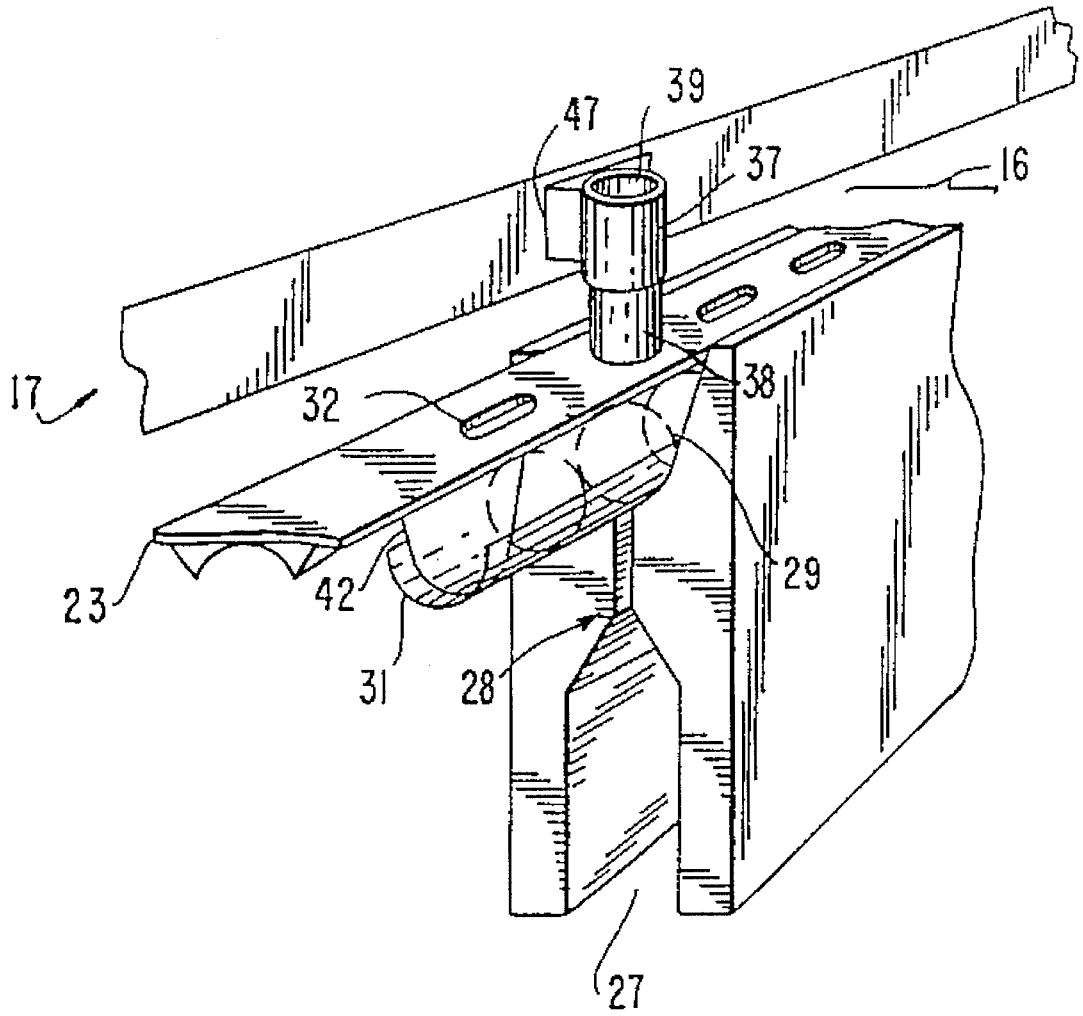
FIG. 11 is a perspective view in fragmentary form of the apparatus of FIGS. 8–10, illustrating the basic relationship between the endless belt, a pocket, the screening belt, the garniture tape, the filter wrap and the garniture.
Figure 12:
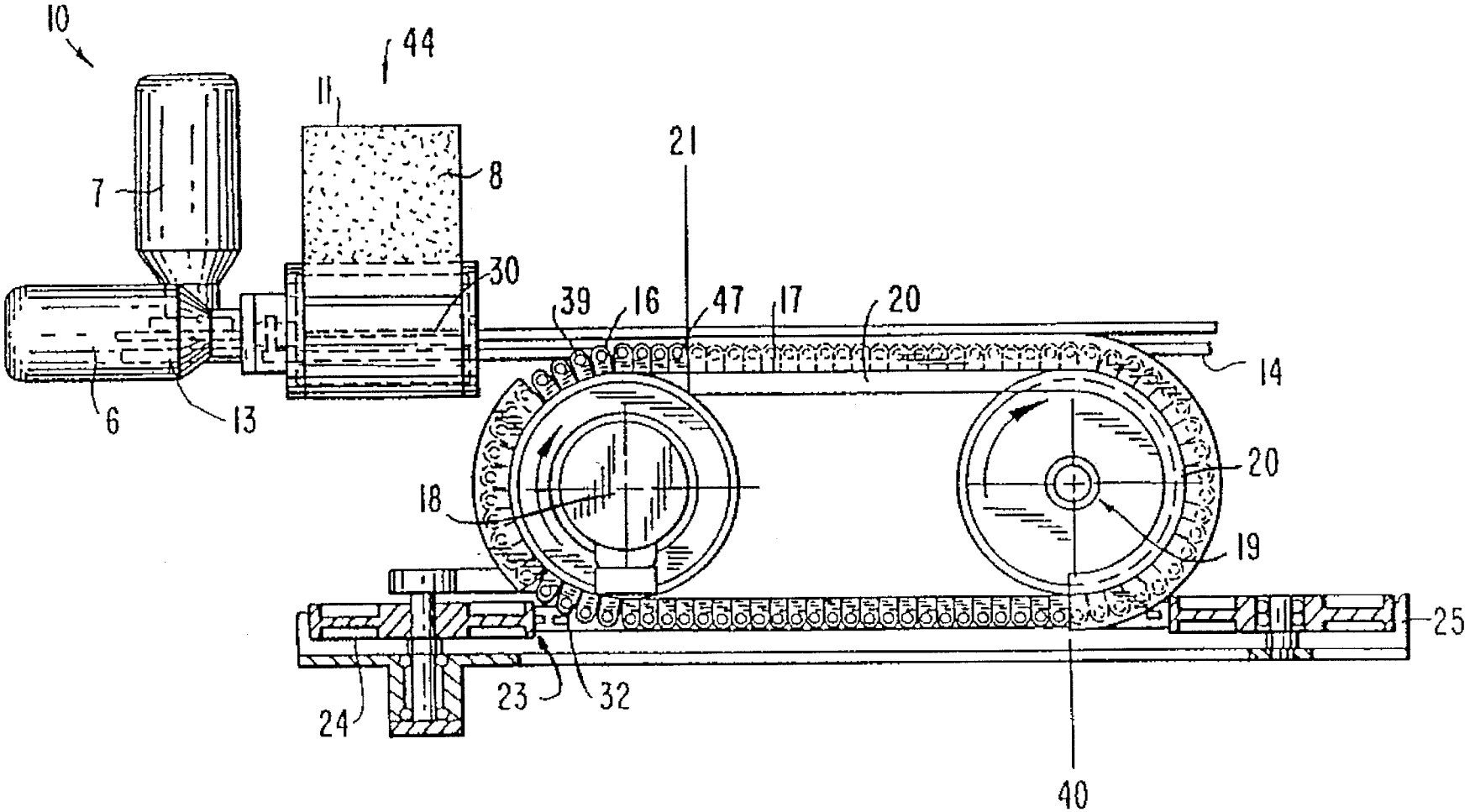
FIG. 12 is a top plan view of the apparatus of FIGS. 8–11, illustrating diagrammatically the basic relationship among the several parts of the apparatus, including the screening belt.

Starting approximately at point 21 of FIG. 1, transport tape 12 conveys the free-flowing material over a course parallel with and underneath a series of moving containers or pockets 16. An individual pocket 16 is represented in FIGS. 6, 7, 9, 10 and 11. FIGS. 4, 5 and 8 each represent a cross-section of a group of pockets and illustrate the relationship of said pockets with other parts of the apparatus.

An aperture 39 perforates each pocket 16. The aperture 39 of each pocket 16 is divided into an upper portion 37 and a lower portion 38 by screen 22 having a suitable mesh size depending on the free-flowing material utilized.

The pockets 16 are individually attached to a continuous or endless belt by a support or stalk 47. Endless belt 17 travels around a plurality of wheels 18 and 19. Said wheels may be aligned and positioned in the horizontal plane in a position approximately perpendicular to wheels 13 and 14. Either or both wheels 18 and 19 may be driven by an electric motor or other suitable method. Wheels 18 and 19 thus function as spaced apart end sprockets providing drive, tension and position for belt 17.

Belt 17 travels a course that eventually becomes parallel with and adjacent to transport tape 12. Belt 17 positions pockets 16 so that the lower portions 38 of pockets 16 travel directly above and proximal to the free-flowing material 8 that is held by vacuum on transport tape 12. During thus parallel travel, belt 17 sequentially carries pockets 16 directly over transport tape 12. Simultaneously, transport tape 12 (see FIG. 4) conveys the free-flowing material 8 over a course directly under pockets 16.

The vacuum applied beneath transport tape 12 provided by vacuum chamber 15 ceases at approximately point 21 (see FIG. 1). As the force of the vacuum applied through transport tape 12 ceases, the free-flowing material is no longer held on the surface of transport tape 12. Also at approximately point 21, pockets 16 pass under a vacuum hood or chamber 20. Vacuum hood 20 applies vacuum through apertures 39 of pockets 16. This vacuum draws the free-flowing material off transport tape 12 and up into the lower portion 38 of each pocket 16. Screen 22 is permeable enough to allow the pull of vacuum, yet tight enough to prevent passage of free-flowing material 8.

Transport tape 12 may be adjusted to run faster or slower than endless belt 17. An optimal speed differential between transport tape 12 and belt 17 will ensure that the vacuum applied to pockets 16 will draw all, or nearly all, of the free-flowing material 8 off transport tape 12, thereby eliminating the need to refeed or recirculate free-flowing material 8.

Belt 17 then conveys pockets 16, each now retaining a discrete amount of free-flowing material 8, under vacuum hood 20 to approximately point 40 (see FIG. 1). While pockets 16 are traveling under vacuum hood 20, the vacuum holds the free-flowing material 8 in place against screen 22 or pockets 16. At approximately point 40, vacuum hood 20 ends. As belt 17 conveys a pocket 16 beyond vacuum hood 20, and atmospheric pressure or slightly positive pressure is applied to the pocket, the vacuum holding free-flowing material 8 in the pocket 16 ceases. Also at approximately point 40, belt 17 travels parallel with and above garniture tape 31. Without vacuum to hold the free-flowing material 8 against screen 22 in pocket 16, the free-flowing material is released above garniture tape 31.

Garniture tape 31 (see FIGS. 5–7) transports plug wrap 42 through a trough called a garniture 29 where plug wrap 42 assumes a trough shape. A series of filter plugs 33 separated by discrete receiving spaces 26 are axially aligned within trough-shaped plug wrap 42. Plug wrap 42 is turned upward so that it directly touches the sides 43 of the lower portion 38 of pocket 16. Both garniture tape 31 and plug wrap 42 are permeable to air.

An independent electrical or electronic device may be used to directly coordinate the travel of belt 17 with the parallel travel of garniture tape 31 such that apertures 39 of pockets 16 sequentially come into register with discrete receiving spaces 26. Thus, at approximately point 40 where vacuum hood 20 ends and atmospheric or positive pressure is introduced into pockets 16, the free-flowing material 8 is sequentially released from pockets 16 to move toward receiving spaces 26.

A vacuum chamber or plenum 27 located beneath garniture 29 draws a vacuum through vacuum slot 28 located in garniture 29. This vacuum is applied through the air permeable garniture tape 31 and plug wrap 42 transported on garniture tape 31. The vacuum created by vacuum plenum 27 draws a vacuum through garniture tape 31 and plug wrap 42, thus creating a negative pressure in the receiving spaces 26. This negative pressure draws the free-flowing material 8 directly into receiving spaces 26. The negative pressure also acts to retain free-flowing material 8 in the discrete receiving spaces 26.

Following this operation garniture tape 31 moves the partially constructed cigarette filter assemblies to the next step of the cigarette filter assembly process.

The preferred embodiment of the invention that is similar to the above described embodiment is illustrated in FIGS. 8–13. As in the above embodiment, garniture tape 31 transports plug wrap 42 through garniture 29 where plug wrap 42 assumes a trough shape. A series of filter plugs 33 separated by discrete receiving spaces 26 are axially aligned within trough-shaped plug wrap 42. This alternative embodiment includes a screening tape or belt 23 that travels between pockets 16 and filter plugs 33 transported through garniture 29. In this alternative embodiment, the plug wrap 42 does not necessarily touch sides 43 of the lower portion 38 of pocket 16.

Figure 13:
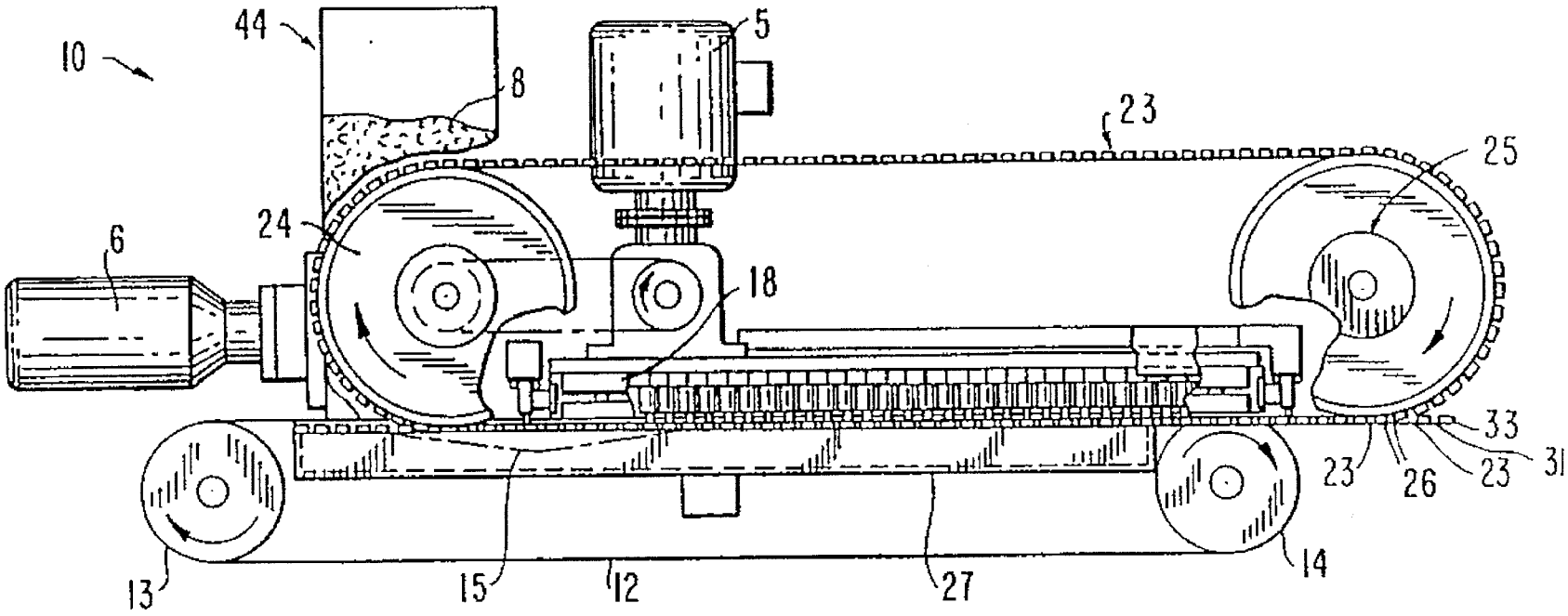
FIG. 13 is a full frontal view of the apparatus of FIGS. 8–12.

Screening tape 23 is an endless tape, traveling around a plurality of wheels 24 and 25 aligned, in sequence and positioned in the vertical plane in a position approximately perpendicular to wheels 18 and 19. Wheels 24 and 25 may be driven by an electric motor 5 as shown or may be driven by other methods. In FIG. 13, motor 5 also serves to drive wheels 18 and 19. Wheels 24 and 25 thus function as spaced apart end sprockets providing drive, tension and position for screening tape 23. Screening tape 23 runs parallel to and directly above garniture tape 31.

Screening tape 23 contains apertures 32. An independent electrical or electronic device may be used to coordinate the travel of belt 17 with the parallel travel of screening tape 23 such that apertures 39 of pockets 16 register with apertures 32 of screening tape 23. Likewise, an independent electrical or electronic device may be used to coordinate the travel of screening tape 23 with the parallel travel of the garniture tape 31. Thus apertures 32 in screening tape 23 directly register with discrete receiving spaces 26, while the non-apertured portion of screening tape 23 masks filter plugs 33.

Thus, as a pocket 16 travels beyond approximately point 40, aperture 39 of pocket 16, an aperture 32 of screening tape 23 and a discrete receiving space 26 between filter plugs 38 will all three come into register. As the vacuum hood 20 ends at approximately point 40, and atmospheric or slightly positive pressure is applied to the pocket 16, the free-flowing material in pocket 16 is free to move through aperture 32 toward discrete receiving spaces 26.

This movement is made more efficient by a vacuum device applied to vacuum chamber or plenum 27 which draws a vacuum through vacuum slot 28 located in garniture 29, through air permeable garniture tape 31 and plug wrap 42. The resulting negative pressure in discrete receiving spaces 26 draws the free-flowing material 8 directly into discrete receiving spaces 26. The negative pressure also acts to retain the free-flowing material 8 in discrete receiving spaces 26.

An alternate embodiment is illustrated in FIGS. 14–17. In this embodiment, transport tape 12 travels around a plurality of wheels 13 and 14 which are located at different levels in a vertical direction so that transport tape 12 travels in a sloping direction between wheels 13 or 14. Transport tape 12 is permeable to air. Vacuum from vacuum plenum 15 beneath transport tape 12 draws through the tape. The vacuum draws the free-flowing material falling from dispensing device 44 onto the surface of transport tape 12 and retains it in place, even as transport tape 12 moves at high speeds.

Figure 14:
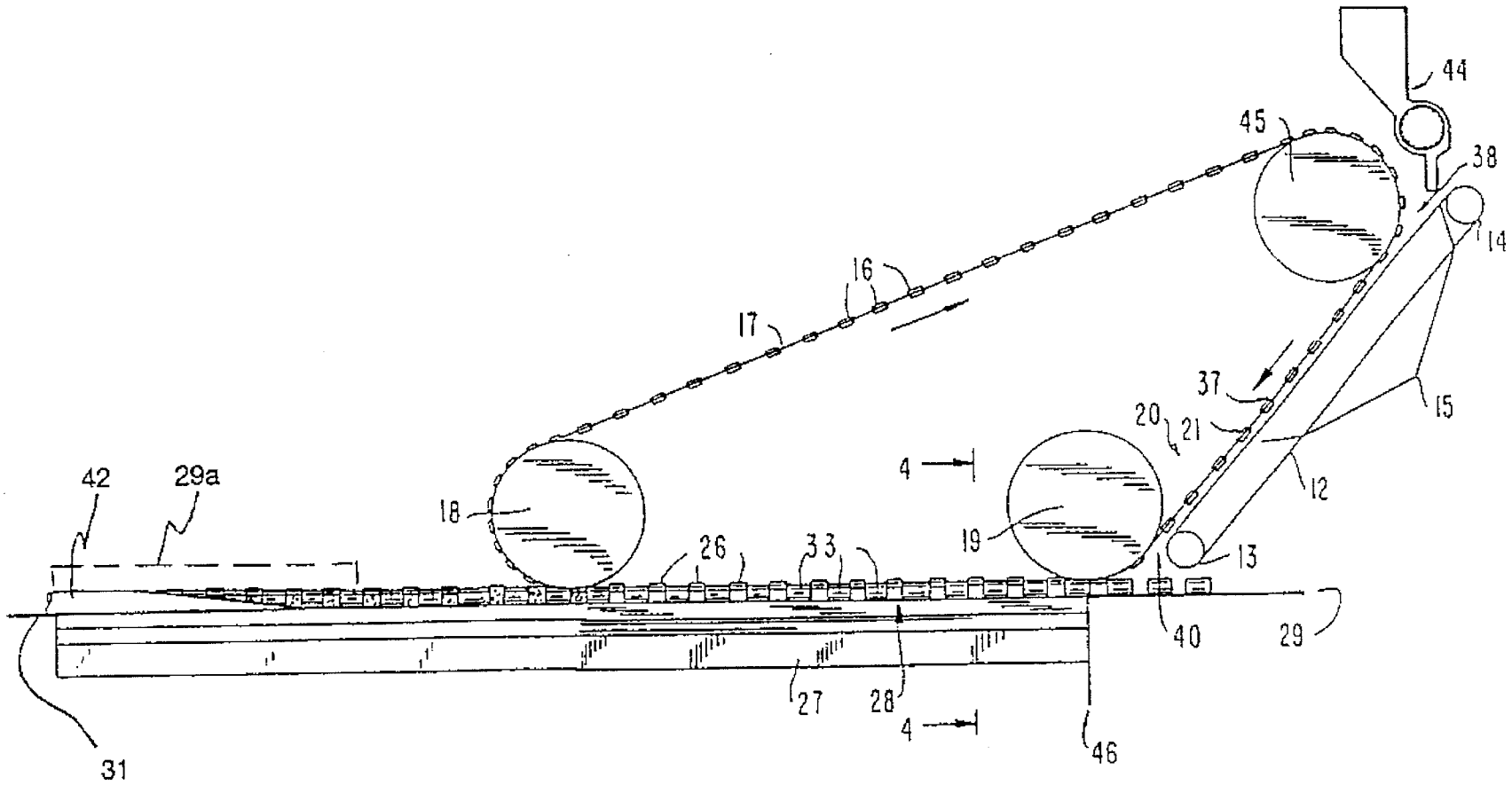
FIG. 14 is a full frontal view of an alternative embodiment of the apparatus of FIG. 1, together with additional provision of a wrapping station.
Figure 15:
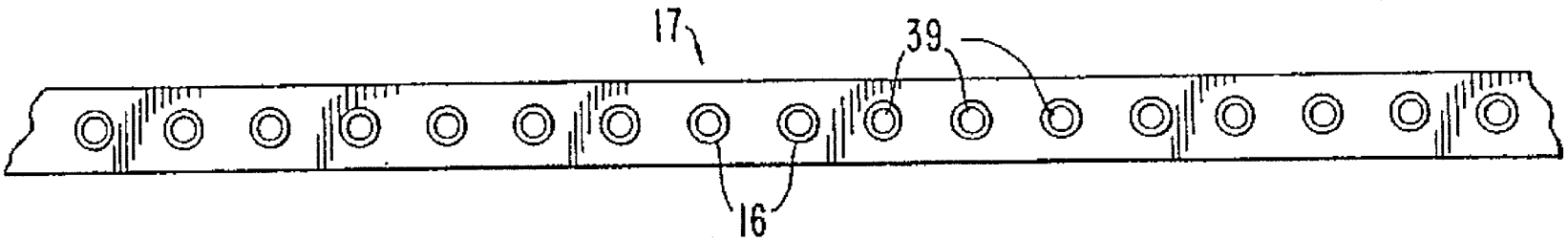
FIG. 15 is a top view of the tape used in the apparatus of FIG. 14, illustrating the basic relationship between the pockets and the endless belt.
Figure 16:
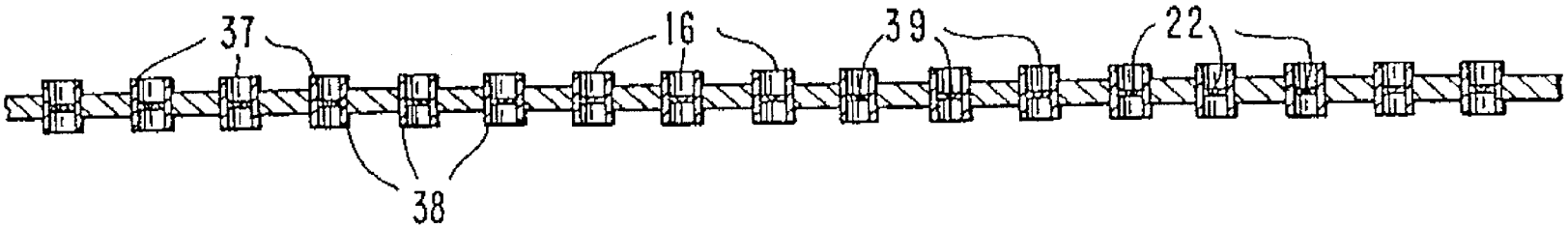
FIG. 16 is a sectional view of a portion of the endless belt of FIG. 13.

In the embodiment of FIGS. 14–17, transport tape 12 conveys the free-flowing material over a path parallel with and underneath a series of pockets 16 that are positioned within endless belt 17, as illustrated in FIGS. 15 and 16. An aperture 39 perforates each pocket 16. Apertures 39 of pockets 16 are divided into an upper portion 37 and a lower portion 38 by screen 22.

Figure 17:
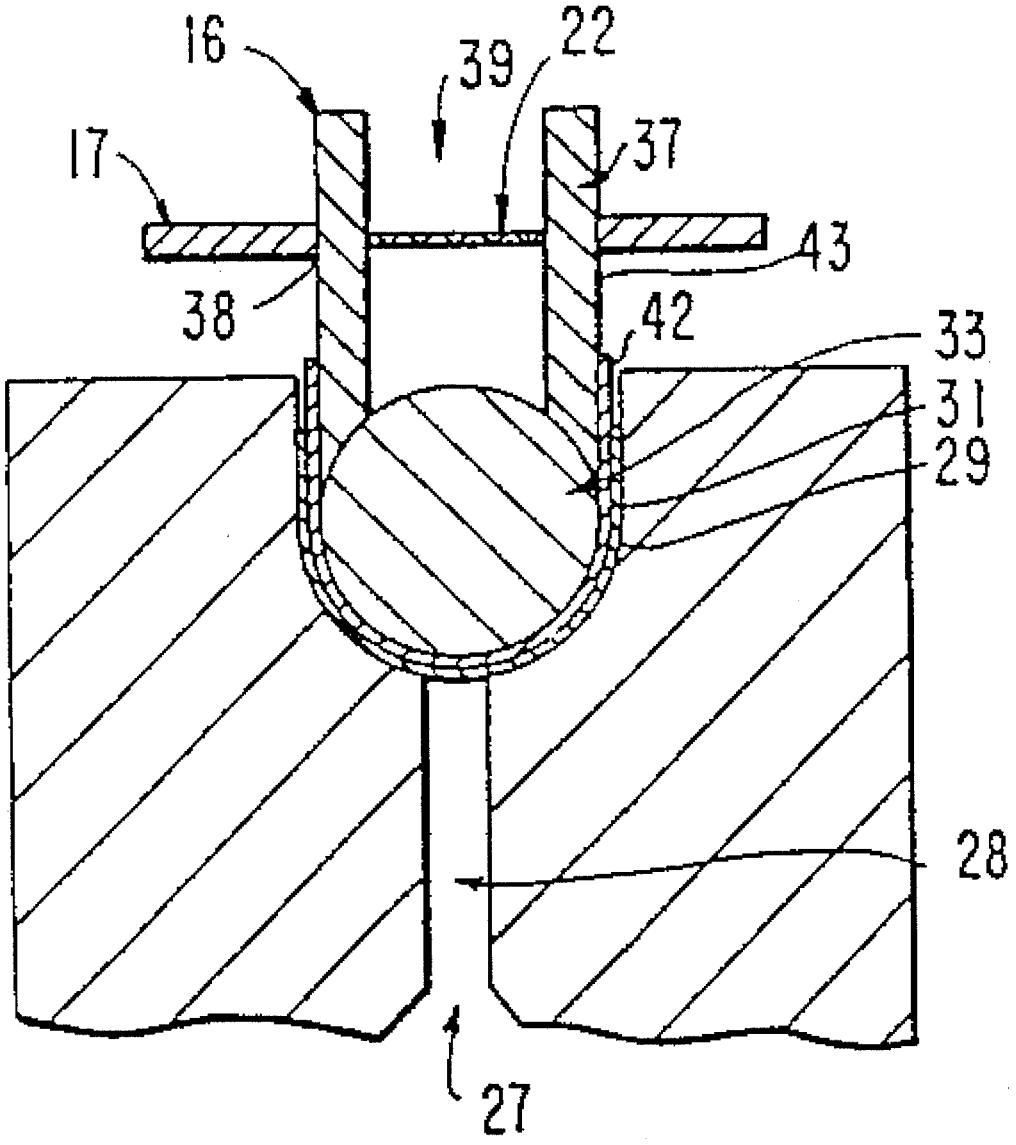
FIG. 17 is a sectional view of the apparatus of FIGS. 14–16, taken from line 4—4 of FIG. 14.

Pockets 16 perforate through and are positioned within belt 17 (see FIGS. 15–17). Belt 17 containing pockets 16, travels around a plurality of wheels 18, 19 and 45. Said wheels are aligned and positioned in the vertical plane position to create a triangular course around which belt 17 travels. One or all of wheels 18, 19 and 45 may be driven by an electric motor or by other suitable means. Wheels 18, 19 and 45 thus function as spaced apart end sprockets providing drive, tension and position for belt 17.

Endless belt 17 travels a course in part parallel with and directly downward sloping transport tape 12. Belt 17 positions pockets 16 so that the lower portions 38 of pockets 16 travel directly above and proximal to the free-flowing material 8 held on transport tape 12 by vacuum. Simultaneously, transport tape 12 conveys the free-flowing material on a path directly under pockets 16.

The effect of the vacuum applied beneath transport tape 12 provided by vacuum chamber or plenum 15 ceases at approximately point 21 (see FIG. 14). As the force of the vacuum applied through transport tape 12 ceases, the free-flowing material is no longer retained on the surface of transport tape 12. Also at approximately point 21, pockets 16 pass directly over the free-flowing material 8 that is on transport tape 12. Also at point 21, pockets 16 pass under a vacuum hood or chamber 20. Vacuum hood 20 applies vacuum through apertures 39 of pockets 16. This vacuum draws the free-flowing material 8 off transport tape 12 and up into the lower portion 38 of pocket 16. Screen 22 is permeable enough to allow the pull of vacuum, yet tight enough to prevent passage of free-flowing material 8.

Transport tape 12 may be adjusted to run faster or slower than endless belt 17. An optimal speed differential between transport tape 12 and belt 17 will ensure that the vacuum applied to pockets 16 will draw all, or nearly all, of the free-flowing material 8 off the tape, thereby eliminating the need to refeed or recirculate free-flowing material 8.

Belt 17 then conveys pockets 16, each retaining a discrete amount of free-flowing material 8, under vacuum hood 20 to approximately point 40. While pockets 16 are traveling under vacuum hood 20, the vacuum holds the free-flowing material 8 in place against screen 22 of pockets 16.

At approximately point 40, vacuum hood 20 ends. Yet vacuum continues to retain the free-flowing material in pockets 16 as belt 17 travels around wheel 19. Wheel 19 blocks apertures 39, thereby preventing atmospheric pressure from relieving the vacuum applied to pockets 16. At approximately point 46, belt 17 travels beyond wheel 19 and apertures 39 are open to atmospheric pressure, relieving the vacuum. Also at approximately point 46, belt 17 travels parallel with and above garniture tape 31. Without vacuum to hold the free-flowing material against screen 22 in pocket 16, the material is released above garniture tape 31.

Garniture tape 31 transports plug wrap 42 through garniture 29 where the plug wrap 42 assumes a trough shape. A series of filter plugs 33 separated by discrete receiving spaces 26 are axially aligned within trough-shaped plug wrap 42. Plug wrap 42 is turned upward so that it directly touches the sides 43 of the lower portion 38 of pockets 16. Both garniture tape 31 and plug wrap 42 are permeable to air.

An independent electrical or electronic device may be used to directly coordinate the travel of belt 17 with the parallel travel of garniture tape 31 such that apertures 39 of pockets 16 sequentially come into register with discrete receiving spaces 26. Thus, at approximately point 46, belt 17 transports pockets 16 beyond wheel 19, and atmospheric or positive pressure relieves the vacuum in pockets 16 thereby sequentially releasing the free-flowing material 8 above receiving spaces 26.

A vacuum chamber or plenum 27 located beneath garniture 29 draws a vacuum through vacuum slot 28 located in garniture 29. This vacuum is applied through the air permeable garniture tape 31 and plug wrap 42 transported on garniture tape 31. The vacuum created by vacuum plenum 27 draws a vacuum through garniture tape 31 and plug wrap 42, thus creating a negative pressure in the receiving spaces 26. This negative pressure draws free-flowing material 8 directly from pockets 16 directly into receiving spaces 26. The negative pressure also acts to retain the free-flowing material 8 in the discrete receiving spaces 26.

In this embodiment, plenum 27 extends along the garniture 29, preferably to a location downstream of where the plug wrap 42 is folded about the filter plug 33 at the wrapping station 29a of the garniture 29. Beyond the wrapping station 29a, the air permeable garniture tape 31 is looped around beneath the garniture 29 to return thereto at a location upstream of location 46. Garniture tape 31 is preferably in the form of an endless belt. The negative pressure induced by the vacuum plenum 27 assures retention of the free-flowing material 8 in the discrete receiving spaces 26 even as the material is moved along beyond the location of wheel 18, so that it is not allowed to escape and possibly be smeared along the plug wrap 42 as the plug wrap 42 is wrapped about the filter plugs 33 at the wrapping station 29a. This positive retention of material during this travel facilitates rapid movement of the filter plug through the machine while maintaining cleanliness of the final product.

For example, one skilled in the art would recognize that if vacuum is not employed to draw the free-flowing material into the receiving space, the travel time for the free-flowing material (e.g., charcoal) could be in,Creased so that gravity alone would be effective.

Figure 18:
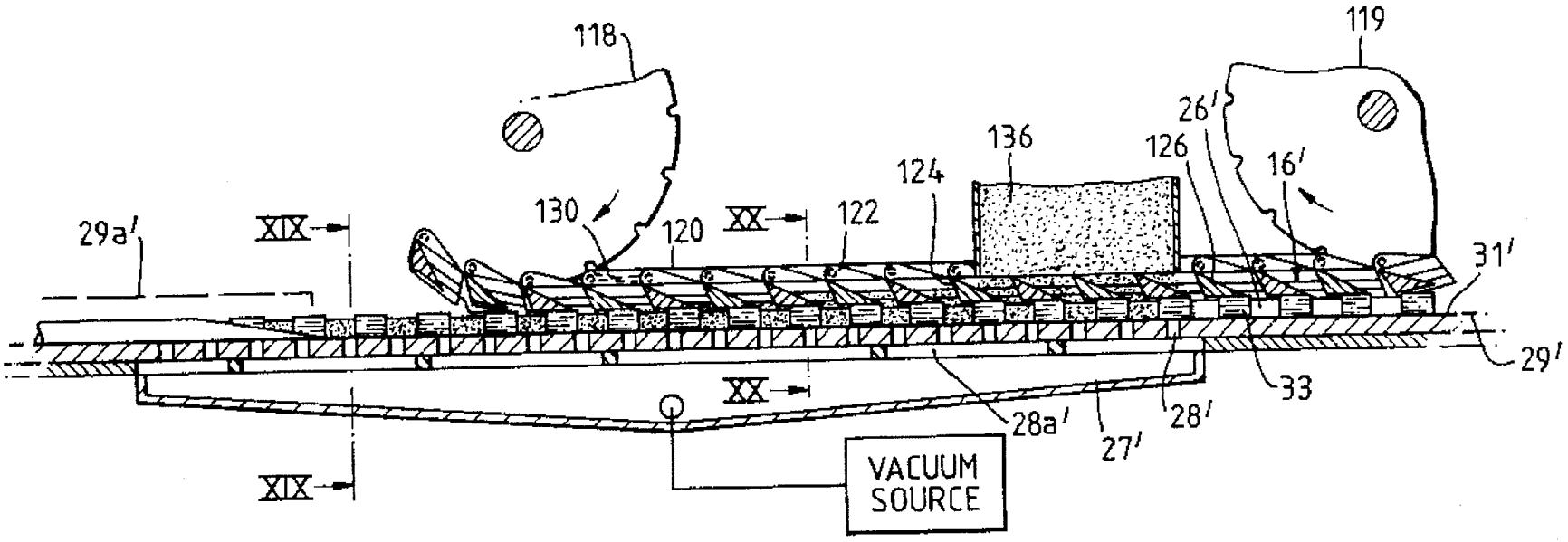
FIG. 18 is a sectional view of another embodiment of the present invention.
Figure 20:
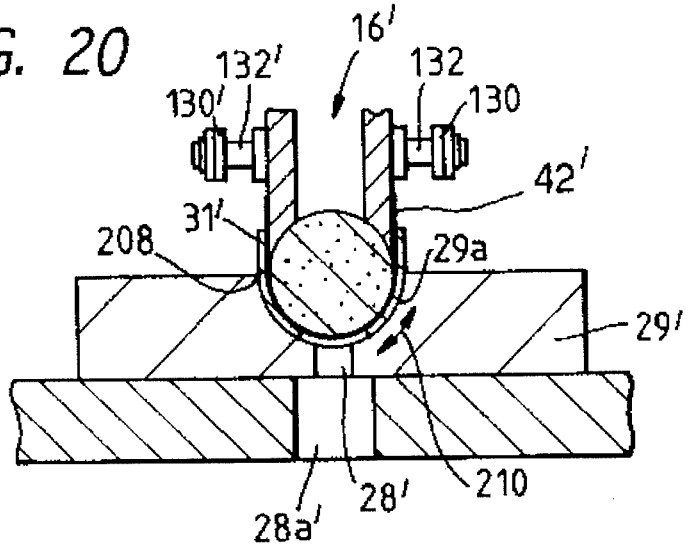
FIG. 20 is a sectional view of the embodiment in FIG. 18, taken at line XX—XX.

Referring to FIGS. 18 and 20, a preferred alternate embodiment of the present invention includes a garniture 29' which receives a plurality of filter plugs 33 in spaced relation along a garniture tape 31', which plugs 33 travel in a direction from right to left in FIG. 18. Sprocket wheels 118 and 119 direct a chain 120 along a path parallel to and above the path of the filter plugs 33. Details concerning the construction and operation of the chain 120 is set forth U.S. Pat. No. 3,623,404 to Jackson, herein incorporated in its entirety by reference. The chain includes links 122 having forward facing surfaces 124 and rearward facing surfaces 126 which define a pocket 16' between adjacent pairs of the surfaces 124 and 126. The links 122 are connected to one another by members 130 and 130' and mesh with the sprocket wheels 118 and 119 at bits 132 and 132'.

The chain 120 is advanced at the same speed as the garniture tape 31' so that each pocket 16' passes beneath a mouth of the hopper chute 136, whereat the pocket 16' receives free-flowing material from the hopper chute 136 upon the influence of gravity. Some portion of the material received at the hopper chute 136 by a pocket 16' continues to fall through the pocket 16' as the pair of links 122 associated therewith continue to traverse toward sprocket wheel 118.

Referring to FIG. 18, the alternate embodiment further comprises a vacuum plenum 27' extending from a location at or preferably just upstream of the hopper chute 136, beyond sprocket wheel 118 and up to but preferably just beyond a location along the garniture 29' whereat wrapping of the plug wrap 42' has been completed at the wrapping station **29*a*' of the garniture 29'. The vacuum plenum 27' is connected to a vacuum source such that the plenum 27' will communicate a vacuum of approximately 30 to 32 inches of water to the garniture tape 31'**.

It is to be understood that although the embodiment shown in FIG. 18 includes links 122 which define only one pocket 16' between pairs of links 122, other link constructions are contemplated as part of the present invention, including those links 122 which provide two or more pockets 16' for each link 122.

Figure 19:
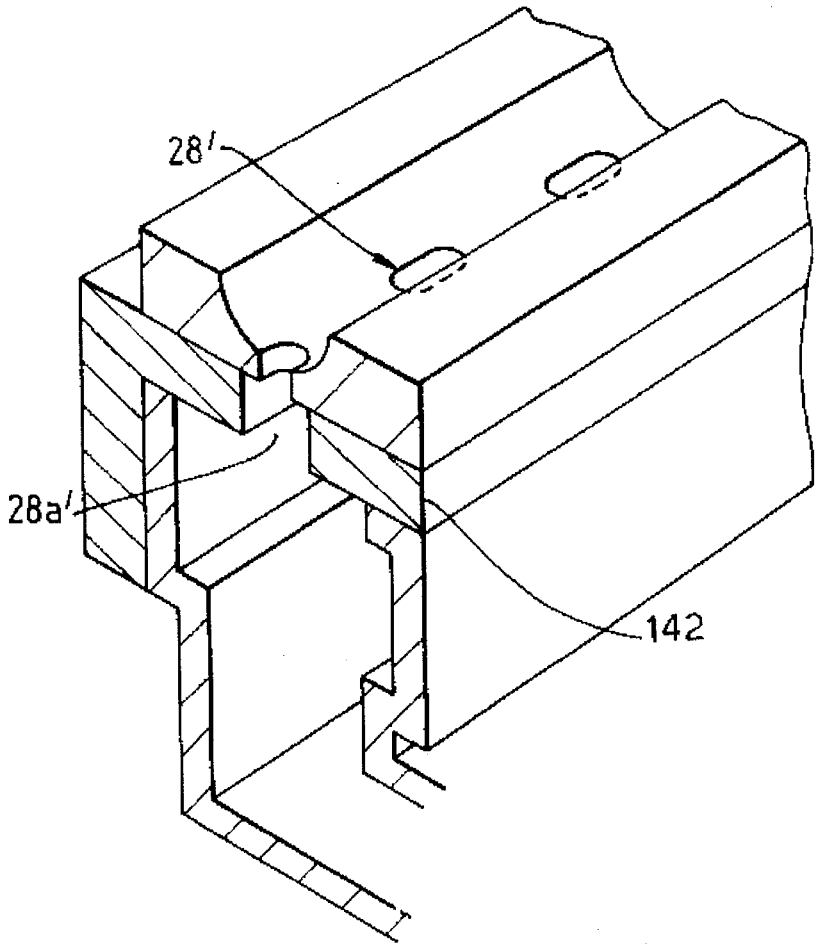
FIG. 19 is a perspective sectional view of the embodiment of FIG. 18, taken at line XIX—XIX.

Referring also to FIGS. 19 and 20, the vacuum within the plenum 27' is preferably communicated through a plurality of vacuum slots 28' located preferably at or just upstream of the hopper chute 136 and beyond the location whereat wrapping is completed at the wrapping station **29*a*' of the garniture 29'**.

Referring particularly to FIG. 20, the vacuum slots 28' are preferably of a highly elongate, oval or obloid cross-sectional shape. Preferably, for conventional cigarettes, the vacuum slots 28' they are approximately ½ to 9/16 inch long and ⅛ to 5/32 inch wide and spaced apart so that they are separated at adjacent edges by ¼ inch. The garniture base member 142 includes larger slots **28*a*', which are wider than the vacuum slots 28' and preferably extend approximately 4⅝ inches long. The relative lengths and geometries of the base slots 28*a*' and those of the vacuum slots 28' are configured respectively so as to minimize interference with the communication of vacuum from the plenum 27' to the underside of the garniture tape 31' and the plug wrap 42'**.

Figure 21:
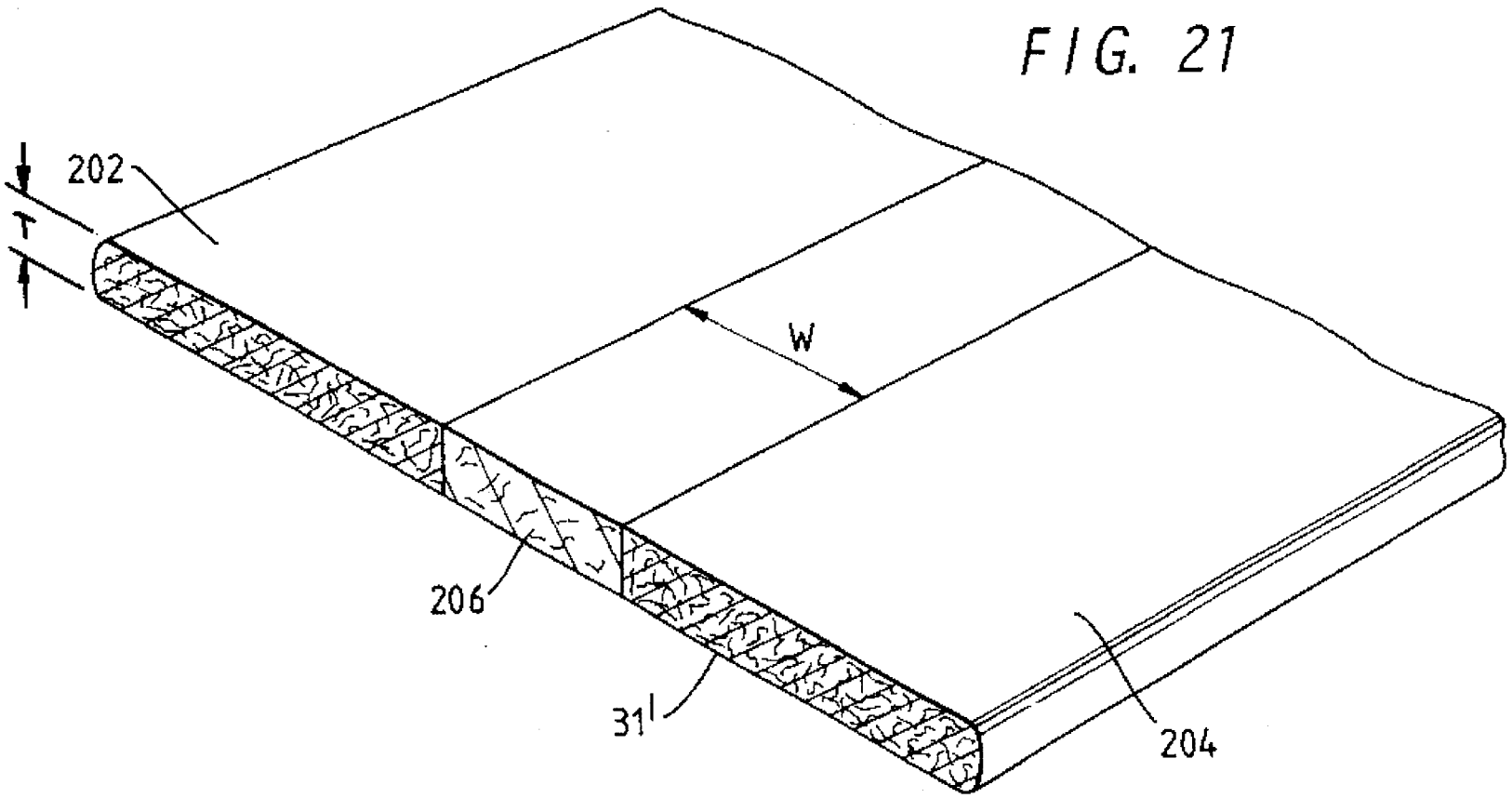
FIG. 21 is a perspective, sectional view of the garniture tape of FIGS. 18 and 20.

Referring particularly to FIGS. 20 and 21, the preferred embodiment includes a garniture tape 31' in the form of an endless belt, having edge portions 202 and 204 of heavy weave fabric and a central portion 206 comprising light weave fabric. In the preferred embodiment, the endless belt is approximately 21 millimeters wide. Preferably, the central portion 206 is arranged symmetrically about the centerline of the garniture tape 31' and has a width W greater than the width of the vacuum slots 28' of the garniture 29'. Preferably, the central portion 206 is approximately 10 mm wide and is of sufficiently loose weaving as to provide approximately 1/32 inch wide openings through its weaving. Preferably, the thickness T of the garniture tape 31' is uniform across the entire tape 31', and preferably is about 0.5 millimeter. The edge portions 202 and 204 are preferably of a heavy weave as is conventionally applied for garniture tapes of prior devices. Of particular concern is that the edge portions 202 and 204 withstand sliding contact along the relatively sharp edge nip 208 of the garniture 29'. In contrast, the weave and spacing between the weave of the central portion 206 is adapted to maximize communication of vacuum from the vacuum slot 28' to the receiving spaces defined between the filter plugs 33.

The width of the central portion 206 is greater than that of the vacuum slot 28' in order to accommodate any tendency of the garniture tape 31' to displace laterally in a direction as indicated by the double-headed arrow 210 in FIG. 20, without interrupting or interfering with the communication of vacuum to the receiving spaces 26' between the filter plugs 33.

Preferably, the outer portions 202 and 204 of the garniture tape 31' are constructed from heavy cotton fiber or a heavy weave linen, with the central portion 206 being constructed of the same material but at a lighter weave. More preferably, the garniture tape 31' is constructed throughout from a wear-resistant material such as Kevlar so as to provide increased endurance and to minimize breakage.

One skilled in the art will appreciate that the present invention can be practices by other than the described embodiments, which are presented for purposes of illustration and not of limitation. The present invention is limited only by the claims which follow.

What is claimed is:

1. A method of manufacturing a continuous filter rod, to provide cigarette filters containing a particulate material, said method comprising the steps of:

moving a wrapping material together with a plurality of spaced apart filter plugs along a path, each adjacent pair of filter plugs defining a receiving space therebetween, said moving step including moving said wrapping material together with said spaced apart plugs on an air permeable garniture tape;

at a first location along said path, delivering a particulate material to each of said receiving spaces;

said moving step further including the step of moving said spaced apart plugs together with said wrapping material along said path to a second location downstream of said first location on said air permeable garniture tape;

wrapping said wrapping material about said spaced apart filter plugs and said material received in said receiving spaces at said second location; and communicating a vacuum through said air permeable garniture tape and said wrapping material throughout a path portion from said first location to said second location so that delivery of said particulate material in said receiving spaces is facilitated and said delivered particulate material is retained by application of vacuum as the delivered particulate material is moved from said first location to said second location.

2. The method as claimed in claim 1, wherein said step of moving said spaced apart filter plugs and said received material includes conveying said spaced apart filter plugs and said received material on a single air permeable garniture tape.

3. The method as claimed in claim 1, wherein said vacuum communicating step includes communicating said vacuum through a central portion of the garniture tape having a looser weave than adjacent edge portions of said garniture tape.

4. The method as claimed in claim 3, wherein said step of moving said spaced apart filter plugs and said received material includes conveying said spaced apart filter plugs and said received material on a single air permeable garniture tape.

5. An apparatus for manufacturing a continuous filter rod, to provide cigarette filters containing a particulate material, said apparatus comprising:

means for moving a wrapping material together with a plurality of spaced apart filter plugs along a path, each adjacent pair of filter plugs defining a receiving space therebetween, said moving means including an air permeable garniture tape;

means for delivering a particulate material to each of said receiving spaces, said delivering means at a first location along said path;

means for wrapping said wrapping material about said spaced apart filter plugs and said material received in said receiving spaces, said wrapping means at a second location downstream of said first location, said air permeable garniture tape extending through said first path portion to at least said second location; and means for communicating a vacuum through said air permeable garniture tape and said wrapping material throughout a path portion from said first location to said second location so that delivery of said particulate material in said receiving spaces is facilitated and said delivered particulate material is retained by application of vacuum as the delivered particulate material is moved from said first location to said second location.

6. The apparatus as claimed in claim 5, wherein said moving means consists essentially of a single air permeable garniture tape.

7. The apparatus as claimed in claim 5, wherein said garniture tape includes a central portion having a looser weave than adjacent edge portions of said garniture tape.

8. The apparatus as claimed in claim 7, wherein said moving means consists essentially of a single air permeable garniture tape.

9. An apparatus for rapidly feeding a free-flowing material into partially-constructed cigarette filter assemblies comprising:

an air permeable garniture tape for moving air permeable cigarette filter plug wrap and a plurality of filter plugs separated by discrete receiving spaces, said garniture tape moving said filter plug wrap and said filter plugs along a transport path;

at least one endless belt which carries a plurality of pockets and is positioned so that a portion of the travel of said pockets is parallel to and above said garniture tape along a first portion of said transport path, each of said pockets being adapted to direct free-flowing material onto said received spaces as said garniture tape moves said filter plug wrap and said filter plugs along said first path portions;

means for folding said plug wrap about said filter plugs and receiving spaces at a second location along said transport path downstream of said first path portion;

means for communicating a vacuum to said air permeable garniture take as said air permeable garniture take moves said filter plug wrap and said plurality of filter plugs along said first path portion of said transport path and along a second portion of said transport path extending from said first path portion to at least said second location;

said air permeable garniture take extending through said first path portion to at least said second location.

10. The apparatus as claimed in claim 9, wherein said air permeable garniture tape consists essentially of a single air permeable garniture tape which extends throughout said transport path.

11. The apparatus as claimed in claim 9, wherein said air permeable garniture tape comprises a central portion and edge portions on opposite sides along said central portion, said central portion being of greater porosity than said edge portions.

12. The apparatus as claimed in claim 11, wherein said air permeable garniture tape consists essentially of a single air permeable garniture tape which extends throughout said transport path.

* * * * *